US008567058B2

(12) United States Patent
Møller et al.

(10) Patent No.: US 8,567,058 B2
(45) Date of Patent: Oct. 29, 2013

(54) SURFACE FINISHING OF ROTOR BLADES FOR WIND TURBINE

(75) Inventors: Hviid Keld Møller, Skjern (DK); Bjarne Siig, Randers (DK); Angelo Sardellano, Crispiano-Taranto (IT)

(73) Assignee: Vestas Wind Systems A/S, Randers SV (DK)

( * ) Notice: Subject to any disclaimer, the term of this patent is extended or adjusted under 35 U.S.C. 154(b) by 1070 days.

(21) Appl. No.: 12/520,400

(22) PCT Filed: Dec. 17, 2007

(86) PCT No.: PCT/EP2007/064095

§ 371 (c)(1),
(2), (4) Date: Sep. 24, 2009

(87) PCT Pub. No.: WO2008/077844

PCT Pub. Date: Jul. 3, 2008

(65) Prior Publication Data

US 2010/0071209 A1 Mar. 25, 2010

(30) Foreign Application Priority Data

Dec. 22, 2006 (WO) ..... PCT/DK2006/000741

(51) Int. Cl.

| | |
|---|---|
| ***B23P 6/00*** | (2006.01) |
| ***B23Q 7/00*** | (2006.01) |
| ***B23Q 15/00*** | (2006.01) |
| ***B24B 51/00*** | (2006.01) |
| ***B24B 7/00*** | (2006.01) |

(52) U.S. Cl.

USPC ..... 29/889.1; 29/402.04; 29/402.06; 29/559; 29/23.51; 29/283; 29/650; 29/709; 451/5; 451/194; 451/365

(58) Field of Classification Search

USPC ..... 29/889.7, 889.71, 889.72, 889.721, 29/889.722, 401.1, 402.01–402.06, 889.1, 29/559, 23.51, 283, 650, 709; 451/364, 451/387, 393, 278, 5, 194, 195, 365

See application file for complete search history.

(56) References Cited

U.S. PATENT DOCUMENTS 3,984,212 A * 10/1976 DeMusis ..... 451/302
4,031,669 A * 6/1977 Koide et al. ..... 451/304

(Continued)

FOREIGN PATENT DOCUMENTS

DE 2753956 3/1979
DE 43 41 498 6/1995

(Continued)

OTHER PUBLICATIONS

PCT International Preliminary Report on Patentability, dated Jul. 2, 2009, International Application No. PCT/EP2007/064095.

*Primary Examiner* — Sarang Afzali
(74) *Attorney, Agent, or Firm* — Patterson & Sheridan, LLP

(57) ABSTRACT

The present invention relates to a method for surface treatment of a wind turbine rotor blade (1) comprising a leading edge and a trailing edge separating substantially opposing first and second surfaces of said rotor blade. The method comprises the steps of providing a wind turbine rotor blade, supporting said rotor blade at least at a root end and at a distal position along a longitudinal axis of the rotor blade and providing moveably arranged first and second surface treatment devices (24, 25) adapted to provide surface treatment of the first and second surfaces of the rotor blade, respectively, wherein the first and second surface treatment devices are moved in opposite directions and towards the leading and trailing edges, respectively, during surface treatment of the first and second surfaces of the rotor blade.

20 Claims, 10 Drawing Sheets

(56) References Cited

U.S. PATENT DOCUMENTS

| | | | | |
|---|---|---|---|---|
| 4,145,846 | A * | 3/1979 | Howland et al. | 451/5 |
| 6,439,961 | B1 * | 8/2002 | Hammond et al. | 451/5 |
| 7,032,279 | B2 * | 4/2006 | McCarvill et al. | 29/90.01 |
| 2002/0072297 | A1 | 6/2002 | Kennerknecht | |

FOREIGN PATENT DOCUMENTS

| | | |
|---|---|---|
| DE | 19909698 | 4/2000 |
| EP | 0 767 030 | 4/1997 |
| EP | 1 410 873 | 4/2004 |
| EP | 1517033 | 3/2005 |
| GB | 2 352 417 | 1/2001 |
| JP | 61 270066 | 11/1986 |
| JP | 2001 353651 | 12/2001 |
| JP | 2006 123059 | 5/2006 |
| WO | WO 95/09714 | 4/1995 |
| WO | WO 03/048569 | 6/2003 |

* cited by examiner (a)

(b)

(a)

(b)

SURFACE FINISHING OF ROTOR BLADES FOR WIND TURBINE

FIELD OF THE INVENTION

The present invention relates to a method for surface finishing, such as grinding, polishing or blasting, of rotor blades for wind turbines. By using the method according to the present invention the required time for treating a rotor blade can be significantly reduced. In addition to this the processes of grinding, polishing, sand blasting or glass blasting become more uniform across the surface of the rotor blade. Finally, the costs associated with grinding, polishing, sand blasting or glass blasting of rotor blades are significantly reduced if the method according to the present invention is used.

BACKGROUND OF THE INVENTION

Various arrangements for simultaneous treating both sides of rotor blades have been suggested in the patent literature.

For example, EP 1 517 033 A1 discloses an apparatus for cleaning oblong objects, such as rotor blades. The apparatus of EP 1 517 033 A comprises two spaced apart main brush devices between which a washing zone is defined. Each brush device is substantially cylindrical in shape having a longitudinal axis, and being rotatable about said longitudinal axis. Each brush device is attached at least in one of its ends to an intermediate frame. One of the attachments comprises hinge means which allows the brush device to pivot in order to ease access to the washing zone.

WO 03/048569 discloses a method and an apparatus for treating a surface of a rotor blade mounted on a wind turbine. The apparatus suggested in WO 03/048569 is adapted to be moved relative to the surface of the rotor blade to be treated. According to WO 03/048569 various forms of treatments, such as washing, finishing and sealing, of a rotor blade mounted on a wind turbine may be carried out.

EP 1 517 033 A is only concerned with cleaning or washing of oblong objects, such as rotor blades for wind turbines. WO 03/04569 is beside cleaning also concerned with other types of treatments of rotor blades. Such other types of treatments could be finishing, painting and sealing. However, WO 03/04569 is only concerned with treatment of rotor blades already mounted on a wind turbine. Thus, WO 03/04569 is only concerned with service aspects of already mounted rotor blades on wind turbines.

Thus, none of the above-mentioned patent applications are concerned with manufacturing of rotor blades in that both EP 1 517 033 A and WO 03/04569 are concerned with service and/or repair of already mounted rotor blades.

One of the most time consuming processes in connection with manufacturing of rotor blades is related to surface treatment of rotor blades prior to painting the rotor blades. The reason for this being that one has to be sure that the surfaces of rotor blades are smooth thereby ensuring that desired aerodynamic properties of the rotor blade are met. In addition, due to considerations regarding generated noise from wind turbines it is of great importance that the surfaces of rotor blades are smooth.

In the field of rotor blade manufacturing it is generally accepted that surface treatment of rotor blades prior to painting is performed as a manual grinding process where a grinding device is manually moved across the surfaces of the rotor blade. As previously stated this is a very time consuming process. To exemplify it takes 15-20 hours for one person to grind both surfaces of a 44 meter long rotor blade. Another disadvantage related to manual grinding of rotor blades is the lack of uniformity of the grinding process.

Therefore, there is a need for optimizing treatments of wind turbine rotor blade surfaces, and at the same time reduce the time required for treating rotor blades.

Thus, it may be seen as an object of the present invention to comply with the above-mentioned needs.

SUMMARY OF THE INVENTION

The above-mentioned object is complied with by providing, in a first aspect, a method for surface treatment of a rotor blade for a wind turbine, the rotor blade comprising a leading edge and a trailing edge separating substantially opposing first and second surfaces of said rotor blade, the method comprising the steps of:

- providing a rotor blade and supporting said rotor blade at least at a root end and at a distal position along a longitudinal axis of the rotor blade, wherein a supporting member at the root end is arranged to prevent rotation of the rotor blade about the longitudinal axis of the rotor blade,
- providing a moveably arranged first surface treatment device adapted to provide surface treatment of the first surface of the rotor blade, and
- providing a moveably arranged second surface treatment device adapted to provide surface treatment of the second surface of the object, wherein the first and second surface treatment devices are moved in opposite directions and towards the leading and trailing edges, respectively, during surface treatment of the first and second surfaces of the rotor blade.

The first and second surfaces of the rotor blade may be doubled-curved surfaces by which is meant that the surfaces of the rotor blade to be treated curves in two mutually perpendicular directions. Such doubled-curved surface profiles may be required in order to comply with predetermined aerodynamic demands.

According to the method of the present invention the first surface treatment device may be moved from the trailing edge to the leading edge during surface treatment of the first surface. Simultaneously, the second surface treatment device may be moved from the leading edge to the trailing edge during surface treatment of the second surface. Thus, the first and second surface treatment devices may be moved in essentially opposite directions during treatment of the rotor blade.

During treatment, the rotor blade may be supported in such a way that the leading edge or the trailing edge defines an upper edge of the rotor blade. Thus, the leading and trailing edges define an essentially vertically oriented axis.

The first and second surface treatment devices may be moved across the respective rotor blades surfaces, and between the leading and trailing edges, at a substantially constant speed. The speed of the first surface treatment device may be the same as the speed of the second surface treatment device.

Forces provided by the first and second surface treatment devices and acting on the rotor blade during surface treatment may be balanced so that bending of the rotor blade along its longitudinal axis may essentially be avoided. Moreover, by balancing the forces experienced by the rotor blade unnecessary torsional loads on the rotor blade is prevented.

The first surface treatment device may be arranged on a first moveable arm being operatively connected to a frame structure adapted to perform a relative movement along the longitudinal axis of the rotor blade. The first moveable arm may be moveable in directions substantially perpendicular to the longitudinal axis of the rotor blade whereby the first surface treatment device is allowed to treat the first surface of the rotor blade. The second surface treatment device may be arranged on a second moveable arm being operatively connected to the frame structure, the second moveable arm being moveable in directions substantially perpendicular to the longitudinal axis of the rotor blade whereby the second surface treatment device is allowed to treat the second surface of the rotor blade.

The first and second surface treatment devices may comprise first and second grinding devices, respectively. Alternatively or in addition, the first and second surface treatment devices may comprise respective devices for polishing, sand blasting, glass blasting, or other physical treatment with an abrasive agent in order to provide surface finishing to a least a part of the rotor blade.

The method according to the first aspect of the present invention may be performed using a surface finishing machine comprising:

- a frame structure being adapted to perform a relative movement parallel to the longitudinal axis of the rotor blade,
- a first surface treatment device being adapted to treat the first surface, the first surface treatment device being arranged on a first moveable arm being operatively connected to the frame structure, the first moveable arm being moveable in directions parallel to second and third axes whereby the first surface treatment device is allowed to treat the first surface of the rotor blade, and
- a second surface treatment device being adapted to treat the second surface, the second surface treatment device being arranged on a second moveable arm being operatively connected to the frame structure, the second moveable arm being moveable in directions parallel to second and third axes whereby the second surface treatment device is allowed to treat the second surface of the rotor blade.

The first surface treatment device may be pivotably arranged relative to the first moveable arm. Thus, the first surface treatment device may pivot about an axis substantially perpendicular to the longitudinal axis. Similarly, the second surface treatment device may be pivotably arranged relative to the second moveable arm about an axis substantially perpendicular to the longitudinal axis.

For practical reasons rotor blades to be treated may be positioned in a substantially horizontal arrangement. In such an arrangement, the longitudinal axis becomes a substantially horizontal axis whereas the axis about which the first surface treatment device is adapted to pivot becomes a substantial vertical axis. Being capable of pivoting about a substantial vertical axis the first surface treatment device may be capable of adjusting to varying surface profiles along the longitudinal direction of a horizontally arranged rotor blade.

The second axis may be substantially perpendicular to the longitudinal axis. Similarly, the third axis may be substantially perpendicular to the longitudinal axis. As previously mentioned the second and third axes define direction of movements of the first moveable arm.

In one embodiment of the surface finishing machine the frame structure is a moveable structure adapted to be moved in directions parallel to the longitudinal axis of a horizontally arranged rotor blade.

The frame structure may comprise first and second uprights, the first upright being operatively connected to the first moveable arm, the second upright being operatively connected to the second arm. The first and second uprights may be arranged in a substantially parallel manner in that the first and second uprights extend from first and second base parts, respectively, in a substantially vertical direction. A first drive means adapted to move the frame structure in directions parallel to the first axis may be provided. Various types of drive means would be capable of moving the frame structure. Thus, among other drive means the first drive means may comprise an electrical motor, such as a DC motor, a synchronous motor or an asynchronous motor.

A second drive means adapted to independently move the first and second moveable arms in directions parallel to the second axis may be provided. The second drive means may comprise an electrical motor, such as a DC motor, a synchronous motor or an asynchronous motor. The second drive means may be adapted to correlate movements of the first and second moveable arms. The surface finishing machine may further comprise third drive means adapted to independently move the first and second moveable arms in directions parallel to the third axis, said third axis being a substantially horizontal axis being substantially perpendicular to the first axis. The third drive means may comprise pneumatic drive means and appropriate control means.

In the following, the surface finishing machine will be disclosed with reference to a grinding machine. However, the present invention should in no way be limited to surface treatments only involving grinding.

In case the first and second surface treatment devices each comprises a grinding device, said grinding device may comprise a rotatably mounted cylinder comprising a plurality of tracks or grooves arranged in an exterior surface thereof, each of said plurality of tracks being adapted to receive and hold a grinding element. Such grinding element may be commercially available grinding elements comprising sanding paper supported by the string of brushes. Each grinding device may further comprise drive means adapted to rotate the cylinder optionally via a drive belt, said drive means comprising an electrical motor, such as a DC motor, a synchronous motor or an asynchronous motor.

The plurality of tracks of each exterior cylinder surface may be linearly shaped tracks arranged, primarily, in a longitudinal direction of the cylinder. By primarily is meant that the linearly shaped track or grooves may be angled relative to a centre axis of the rotatably mounted cylinder. Furthermore, the plurality of tracks of a cylinder surface may be arranged in a substantial parallel manner.

Each grinding device may further comprise a distance arrangement adapted to abut the first or second doubled-curved surfaces upon grinding of the object, said distance arrangement defining a minimum working distance between the first or second surfaces and a central axis of the cylinder during grinding of the object. Each distance arrangement may comprise a first and a second set of rotatably mounted wheels, said first and second sets of wheels being arranged on first and second mounts, said first and second mounts being axially arranged relative to the cylinder. Thus, each grinding device may comprise a rotatably mounted cylinder axially arranged between two distance arrangement each comprising a mount and a plurality of rotatably mounted wheels arranged thereon.

The first set of wheels may be arranged on a curved portion of the first mount. Similarly, the second set of wheels may be arranged on a curved portion of the second mount.

The surface finishing machine may further comprise a dust removing arrangement adapted to lead grinding dust away from the grinding device. The surface finishing machine may further comprise control means at least adapted to control the relative movement between the frame structure and the object, and to control movements of at least the first moveable arm.

Preferably, the overall operation of the surface finishing machine may be controlled by a PLC-based control module having a user friendly interface. The user of the surface finishing machine may enter control parameters, such as the length or the type of a rotor blade to be grinded, into the control module, for example via a touch screen provided on a control panel. Other predetermined control parameters may already be stored in the control module.

Preferably, the control module is capable of controlling and coordinating simultaneously movements of the surface finishing machine along the longitudinal direction of the rotor blade, the vertical and horizontal movements of the two moveable arms, and operation and control of the two grinding devices pivotably coupled to respective ones of the two moveably arms. Thus, by entering for example only the dimensions of the rotor blade to be grinded the surface finishing machine automatically grinds the two doubled-curved surfaces of the rotor blade.

Prior to start grinding, the method may further comprise the step of moving the first and second grinding devices to respective starting grinding positions by positioning the first and second grinding devices using the first and second moveable arms, respectively. The method may further comprise the step of activating each of the first and second grinding devices, and grinding, in a substantially simultaneously manner, at least part of the first and second doubled-curved surfaces of the rotor blade.

BRIEF DESCRIPTION OF THE DRAWINGS

The present invention will now be explained in further details with reference to the accompanying figures, wherein.

Figure 1:
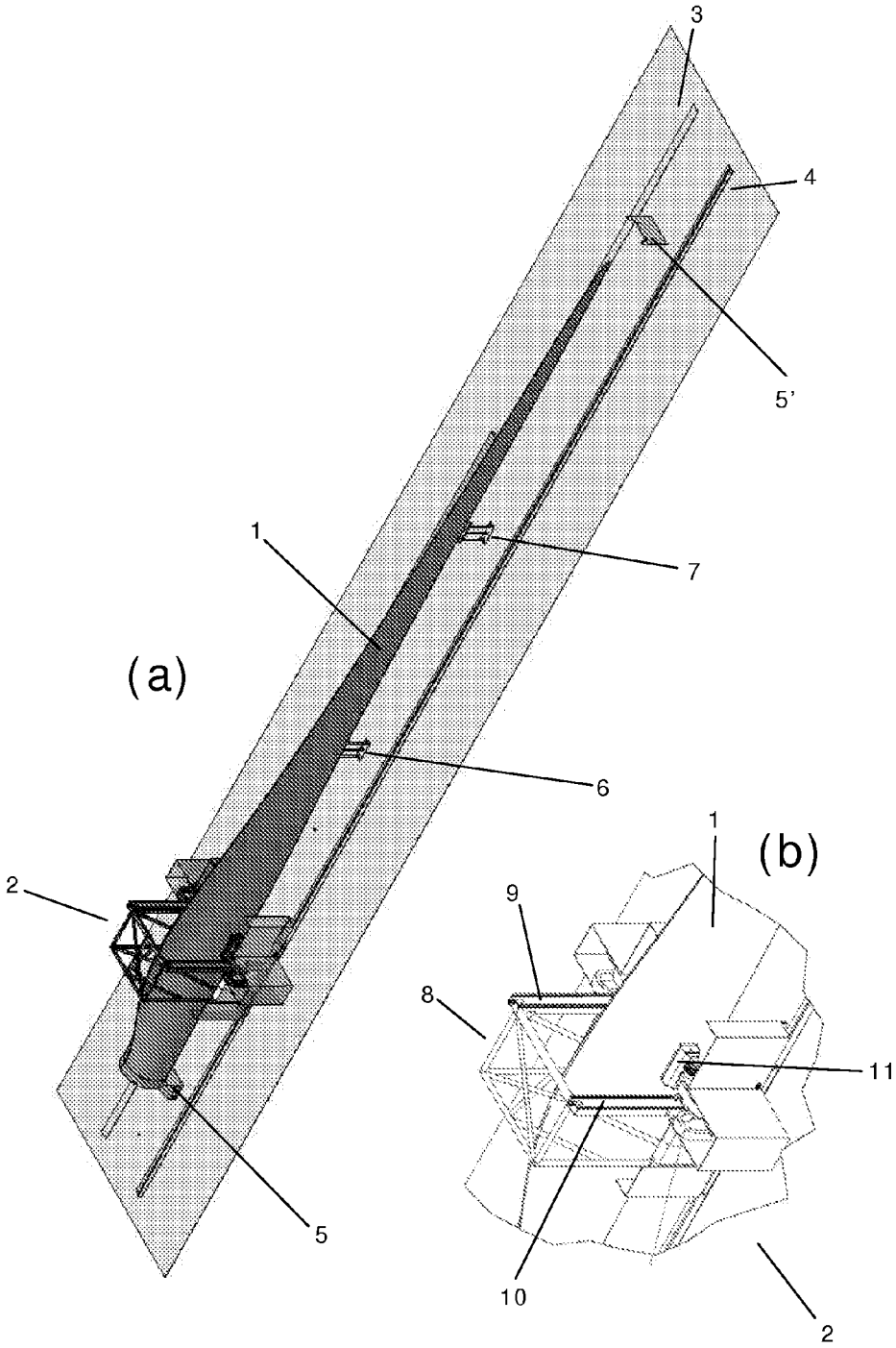
FIG. 1 shows a rotor blade positioned in the automatic surface finishing machine.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to a method suitable for treating doubled-curved surfaces, such as doubled-curved surfaces of rotor blades for wind turbines. The method according to the present invention makes use of a surface finishing machine equipped with appropriate control means so that opposing doubled-curved surfaces of a rotor blade may be treated automatically. The control means further facilitates that opposing doubled-curved surfaces of a rotor blade can be treated simultaneously. It is an advantage of the present invention that the surface finishing process of rotor blades is optimized whereby, among other advantages, a more uniform treatment of the rotor blade surface is achieved. Furthermore, the time required for treating rotor blades is significantly reduced compared to manual processes.

Moreover, it is an advantage of the present invention that forces provided by a first and a second surface treatment device are balanced so as to avoid bending of a distal and thereby thin end of the rotor blade during treatment.

According to the method of the present invention a treatment of a rotor blade may involve grinding, polishing, sand blasting or glass blasting of the surfaces of the rotor blade. For simplicity reasons, the present invention will be described with reference to a grinding machine and an associated grinding process. However, the present invention should in no way be limited to surface treatments only involving grinding.

FIG. 1*a* depicts a rotor blade 1 positioned in the automatic grinding machine 2. It should be noted that the orientation of the rotor blade relative the grinding machine could as well be opposite, i.e. with the thin end of the rotor blade positioned in the grinding machine. The grinding machine 2 is arranged to be moved along the longitudinal direction of the rotor blade along tracks 3, 4. The rotor blade depicted in FIG. 1*a* is a 44 m long rotor blade, but obviously, rotor blades with different lengths can also be grinded with the automatic grinding machine. As depicted in FIG. 1*a* the rotor blade is positioned in a nearly horizontal position supported by supporting elements 5, 6, 7. Supporting element 5' is used to secure the base end of the rotor blade in case the rotor blade is positioned oppositely.

FIG. 1*b* shows a close-up of the grinding machine 2 with the rotor blade 1 positioned in the machine. As seen, the grinding machine comprises a frame structure 8 having two vertically arranged uprights 9, 10. An arm (not shown in FIG. 1*b*) is moveably coupled to each of the uprights 9, 10 so that the grinding device 11 can be freely moved between the front end and the back end of the rotor blade. The grinding device 11 is pivotably coupled to the arm moveably arranged to upright 10. Thus, by combining the vertical movements of the moveable arms and the horizontal movement of the frame structure 8 relative to the rotor blade 1 the two opposing doubled-curved surfaces of the rotor blade 1 can be grinding simultaneously.

Figure 2A:
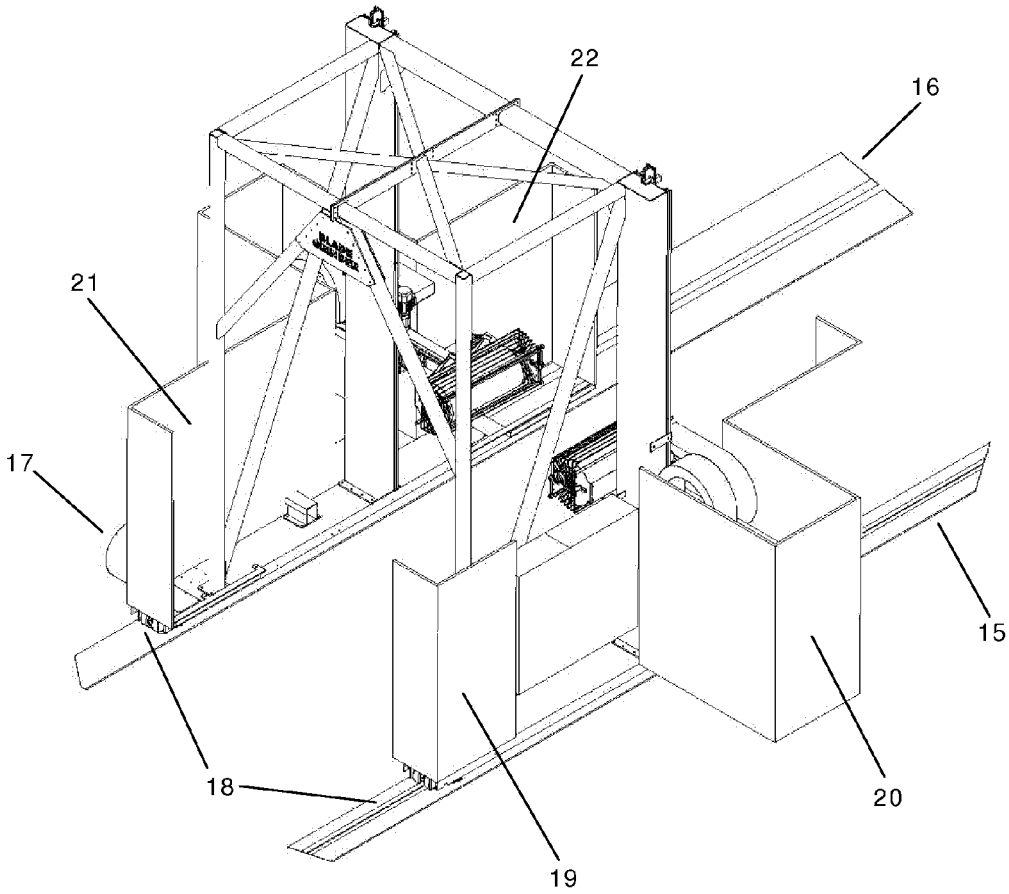
FIG. 2 shows a close-up of the automatic surface finishing machine.
Figure 2B:
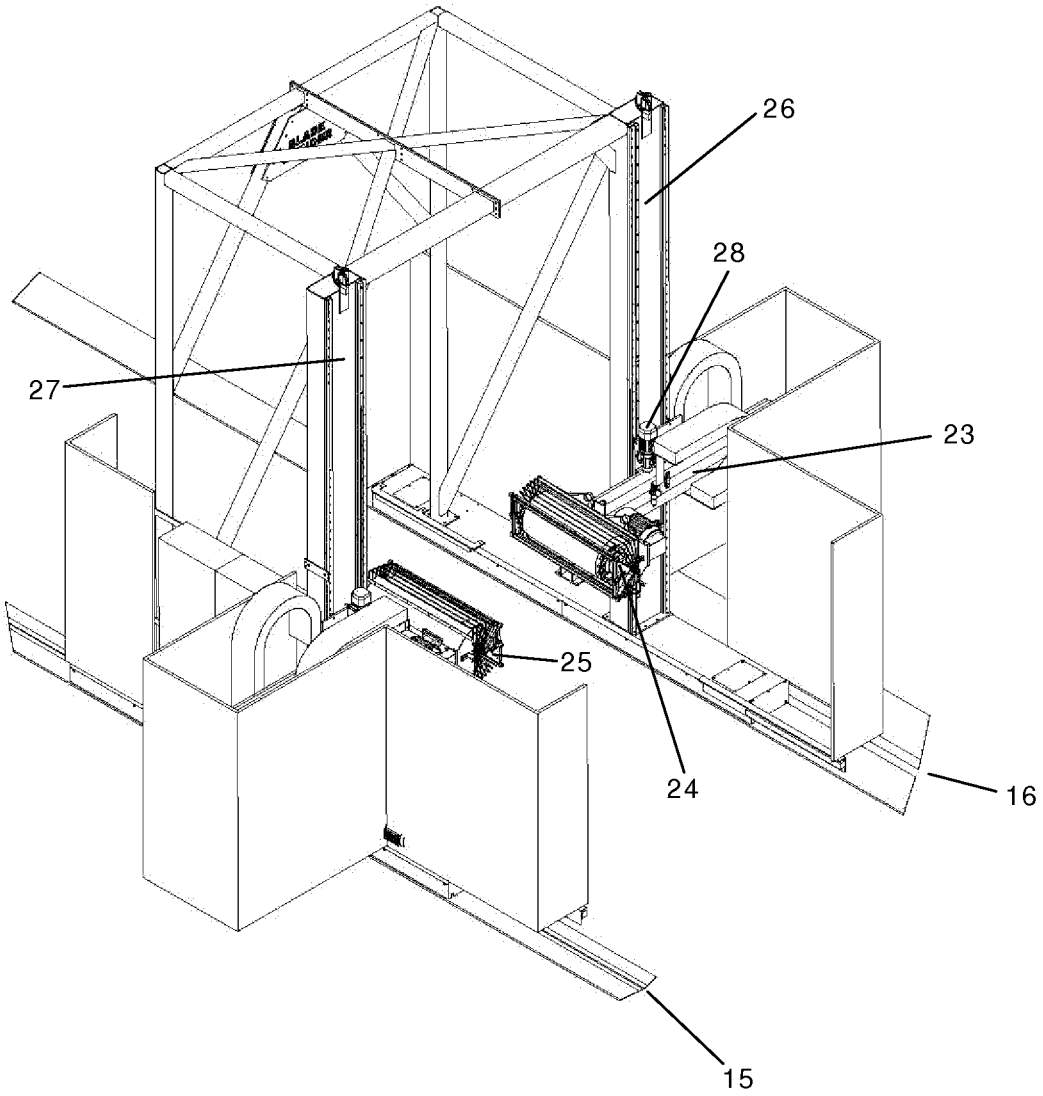

FIGS. 2*a* and 2*b* show the automatic grinding machine in two different perspectives. As depicted in both figures the grinding machine is moveably arranged on guiding tracks 15, 16. As previously mentioned these guiding tracks are arranged to guide the grinding machine along a longitudinal direction of a horizontally arranged rotor blade. An electric motor 17 is provided for moving the grinding machine along guiding tracks 15, 16. The electric motor is coupled to a number of wheels 18 which allows the grinding machine to move along the longitudinal direction of the rotor blade. A plurality of additional wheels (not shown) support the grinding machine on the guiding tracks 15, 16. Protection shields 19, 20, 21, 22 surround the grinding machine so as to minimize the risk of people getting injured during operation of the grinding machine.

FIG. 2*b* shows the grinding machine from a different perspective. A moveable arrangement comprising two moveable arms 23 (only one arm is shown) with grinding devices 24, 25 coupled thereto is arranged to move vertically along each of uprights 26, 27. Each of the two grinding devices 24, 25 will be described in further details in connection with FIGS. 5-8. The moveable arms are moveable along uprights 26, 27 by an electric motor 28 (only one electric motor is depicted in FIG. 2*b*). Obviously, other types of means for moving the moveable arms, such as hydraulic or pneumatic means, are also applicable. The moveable arms should be able to perform a vertical movement at least matching the height of a horizontally positioned rotor blade. Thus, in case of a 44 m long rotor blade the movable arms should be capable of traveling a vertical distance of at least 4 m.

In order to be able to follow the two doubled-curved surfaces of a rotor blade the grinding devices 24, 25 should be moveable toward and away from the surfaces of the rotor blade. Thus, the grinding devices 24, 25 should be capable of being moved along a substantial horizontal direction perpendicular to the longitudinal direction of the rotor blade. The movements of the grinding devices 24, 25 toward and away from the rotor blade is provided by horizontally displacing the moveably arms to which the grinding device 24, 25 are pivotably coupled. The horizontal movement of each of the moveable arms is provided by pneumatic means, but other arrangements can also be applied. In order to be able to follow the doubled-curved surfaces of the rotor blade the grinding devices 24, 25 are, as previously mentioned, pivotably coupled to the moveably arms. Thus, each of the grinding devices 24, 25 are arranged to pivot about a substantially vertical axis whereby each of the grinding devices is allowed to adjust to angled surface portions in the longitudinal direction of the rotor blade.

Figure 3:
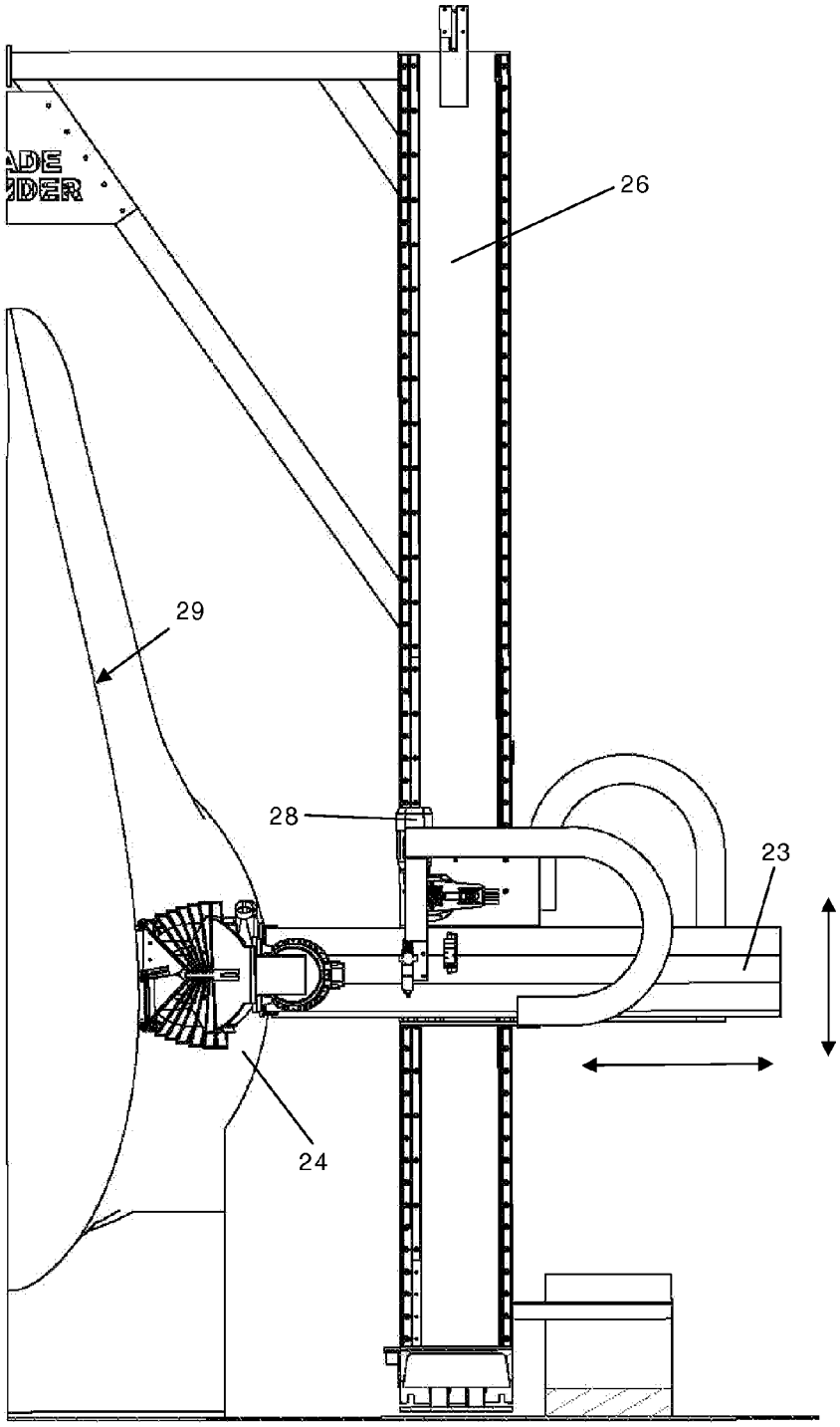
FIG. 3 shows a cross-sectional view of the frame structure of the automatic surface finishing machine.

FIG. 3 shows a cross-sectional view of the right side of the automatic grinding machine depicted in FIG. 2*b*. Applying the same reference numerals as in FIG. 2*a* FIG. 3 shows the moveably arranged arm 23 coupled to upright 26. An electric motor 28 with appropriate mechanical coupling arrangements, such as for example gear arrangements, moves arm 23 along upright 26 in response to provided motor control signals. The grinding device 24 is pivotably coupled to the arm 23 so that the grinding device 24 can pivot about a substantially vertical axis. During grinding the moveably arm 23 brings the grinding device in contact with the surface 29 of the rotor blade. A control mechanism ensures that, during grinding, the grinding device is mechanically biased toward the surface of the rotor blade with a predetermined force. As mentioned above, pneumatic means (not shown) provide horizontal movements of the arm 23.

Figure 4:
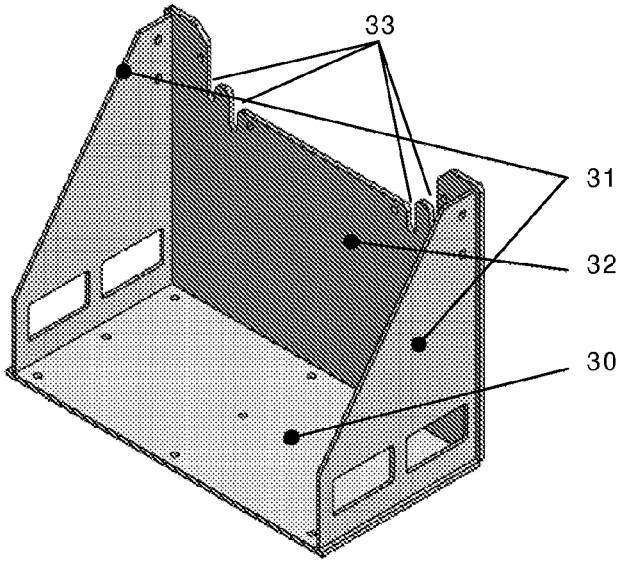
FIG. 4 shows support elements for supporting a rotor blade positioned in the automatic surface finishing machine.
Figure 4:
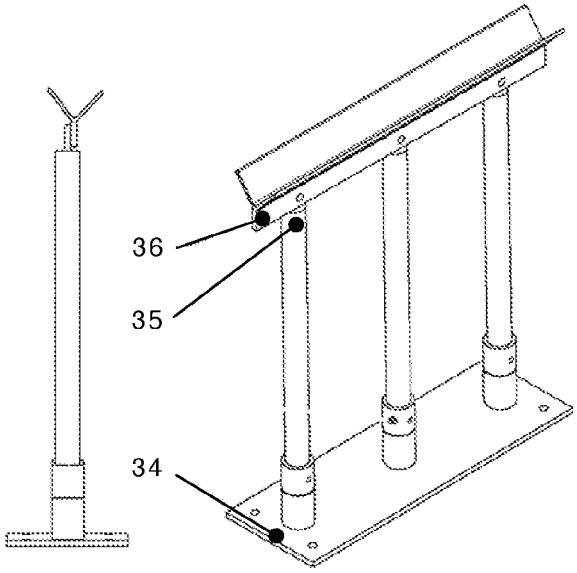

FIG. 4 depicts supporting elements for supporting a horizontally arranged rotor blade. As seen from FIG. 4*a* the supporting element to which the base of the rotor blade is secured comprises a base portion 30, two side portions 31 and a securing portion 32. In the securing portion 32 a number, here four, of tracks 33 are arranged. Each of these tracks is adapted to receive a bolt secured into the base of the rotor blade. FIG. 4*b* shows a supporting element for supporting the body of the rotor blade. The supporting element of FIG. 4*b* comprises a base 34, three uprights 35, and a V-shaped holder 36 for receiving an edge the rotor blade. The positioning of the supporting elements is illustrated in FIG. 1.

Figure 5:
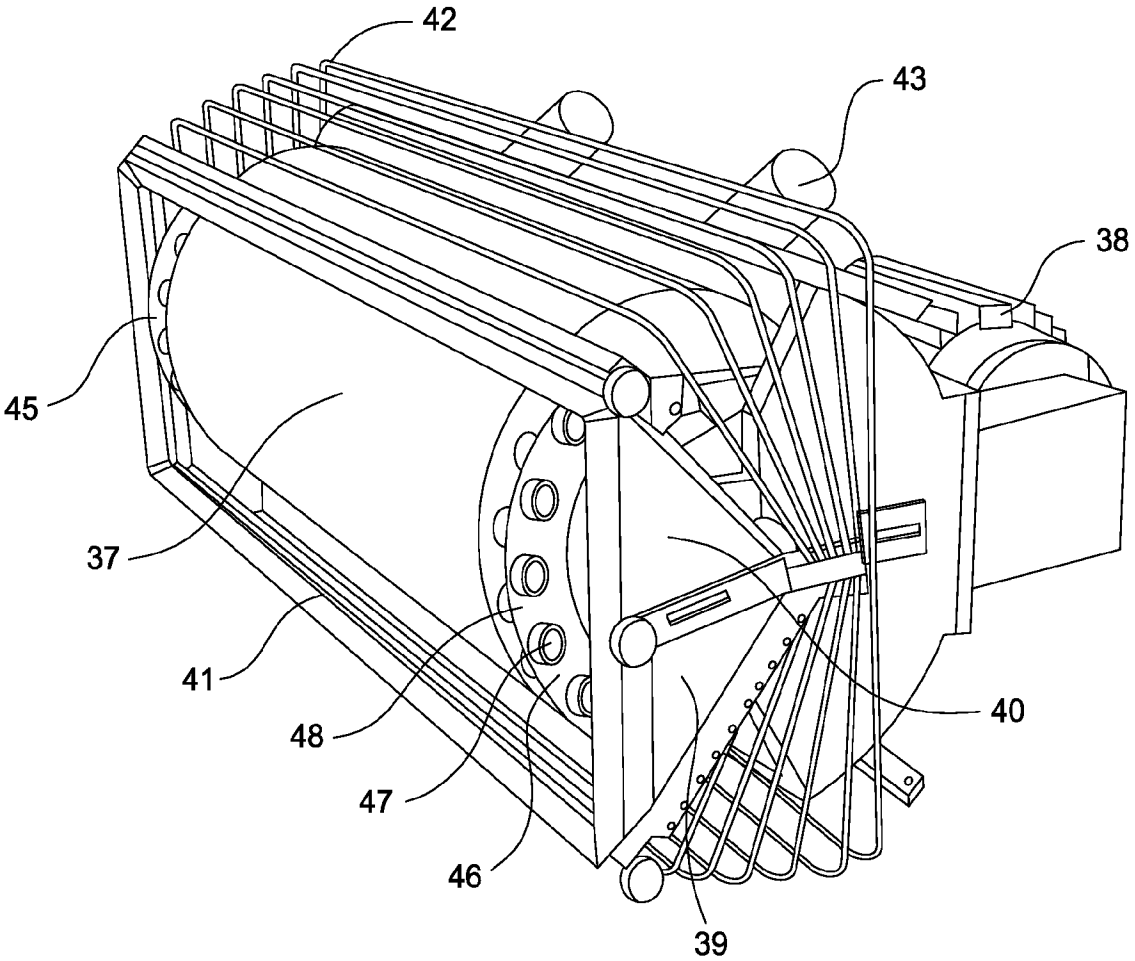
FIG. 5 shows a side view of a grinding device of the automatic surface finishing machine.

FIG. 5 shows a grinding device of the automatic grinding machine. As depicted in FIG. 2 the automatic grinding machine applies two grinding devices, one grinding device for grinding each of the opposing doubled-curved surfaces of a rotor blade. As seen from FIG. 5 a grinding device comprises a rototably mounted grinding element 37 driven by an electric motor 38 via a drive belt (not shown). The electric motor 38 can be a synchronous, an asynchronous or a DC motor. The grinding device further comprises a set of moveable shields 39, 40 which are tiltably arranged so as to be able to follow vertical contour variations of a surface of a rotor blade. In order not to damage or scratch the surface of the rotor blade, and for ensuring proper contact between the grinding device and the surface of the rotor blade, the edges of moveable shields 39, 40 are equipped with soft brushes 41 extending of the edges of the moveable shields 39, 40. A plurality of pivotably mounted support elements 42 are provided for supporting two bellow-like shields (not shown). These bellow-like shields will, in combination with the moveable shields 39, 40, minimize the amount of grinding dust escaping from the interior of the grinding device. To lead grinding dust away from the grinding device a pair of suction connection branches 43 is provided. These suction connections branches are connected, via a pair of flexible tubes, to an external suction arrangement.

The grinding element 37 comprises a rotatably mounted cylindrical element having a plurality of linear surface grooves arranged therein. Preferably, the plurality of linear surface grooves are arranged in a substantial parallel manner. In terms of orientation the plurality of surface grooves are, preferably, angle relative to a centre axis the cylindrical element. Each of the surface grooves is adapted to host a grinding brush comprising radial extending sanding paper supported by flexible brushes. Such grinding brushes are commercially available from various suppliers. The overall length of the grinding element is approximately 80 cm. The height of the grinding elements is around 5 cm.

To secure uniform grinding of the surfaces of the rotor blade a pair of distance securing members 48, 45 are provided on opposite sites of the grinding element 37. These distance securing members 48, 45 set the working distance between the surface of the rotor blade and the grinding device. As depicted in FIG. 5 each distance securing member 48, 45 comprises a frame structure 46 and a plurality of rotatably mounted wheels 47 arranged thereon. During grinding some of wheels 47 abut the surface of the rotor blade being grinded. A more detailed description of these distance securing members is given below.

During grinding of a surface part of a rotor blade the relevant grinding device is mechanically biased toward the surface part being grinded. By mechanically biased is meant that the grinding device is pushed towards the surface with an essentially constant and predetermined force. As previously mentioned the grinding device is moved towards the surface of the rotor blade by pneumatic means. A control mechanism in form of a feedback loop ensures that the pneumatic means maintains the predetermined force between the grinding device and the surface of the rotor blade. The biasing force can be varied to fulfil specific demands such as grinding speed, the type of sanding paper etc.

Figure 6:
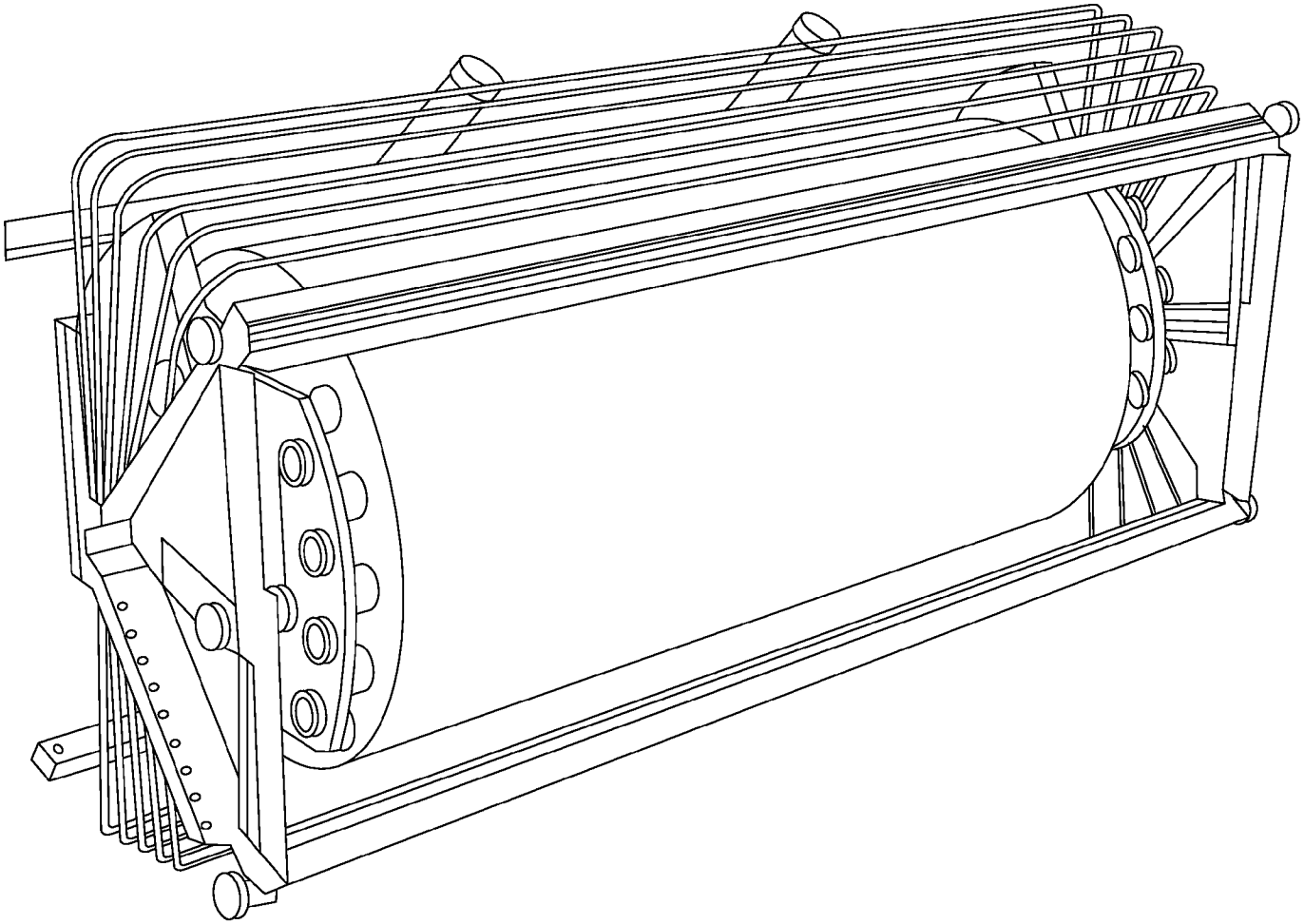
FIG. 6 shows a bottom view of a grinding device of the automatic surface finishing machine.
Figure 7:
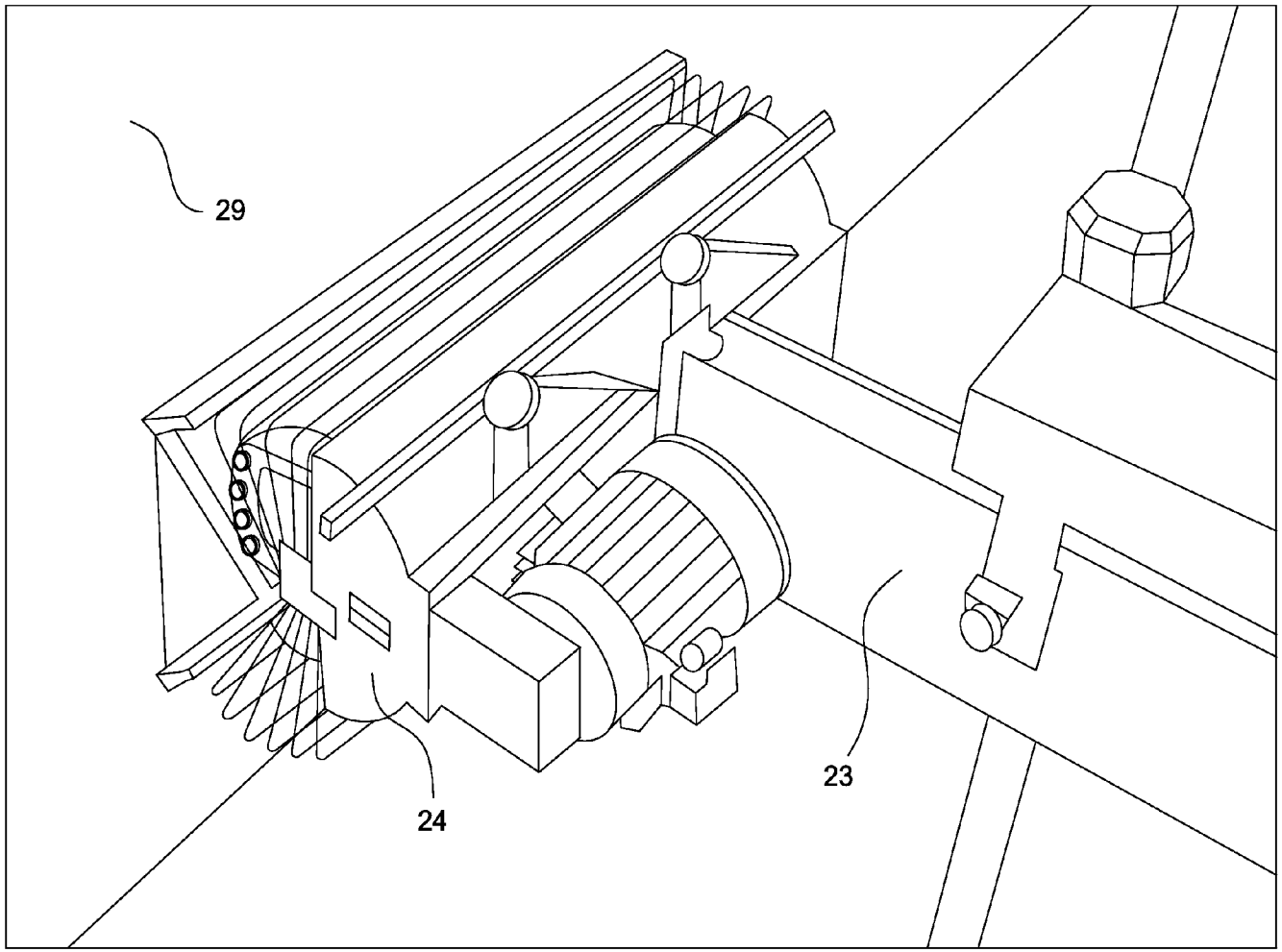
FIG. 7 shows a grinding device abutting a surface of a rotor blade.

FIG. 6 shows the grinding device in a bottom view perspective, whereas FIG. 7 shows a grinding device 24 (or 25) pivotably coupled to the movably arranged arm 23 and abutting a surface 29 of a rotor blade.

Figure 8:
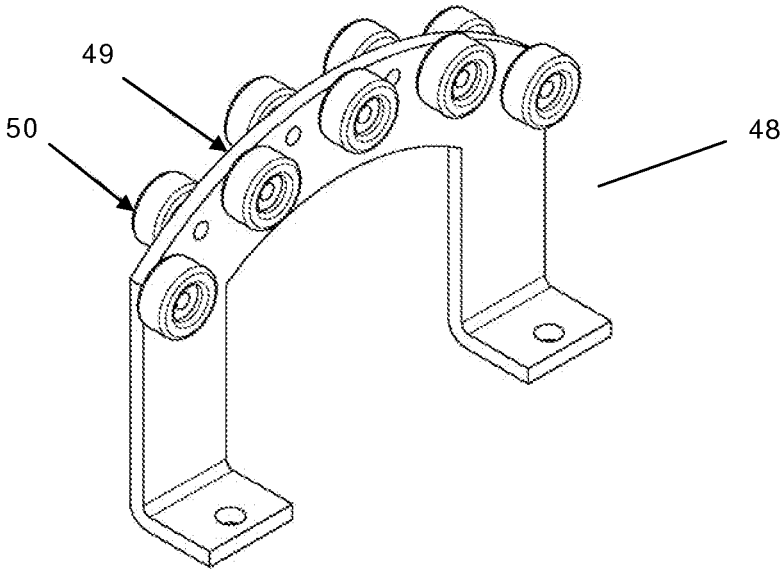
FIG. 8 shows a distance member of a grinding device.
Figure 8:
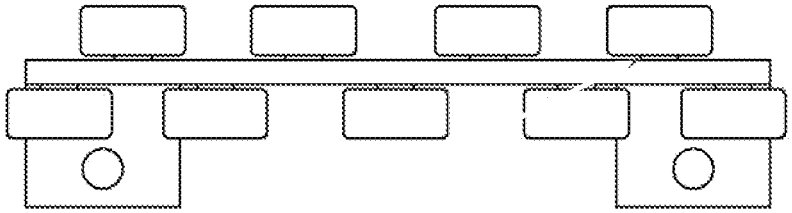

FIG. 8 shows a distance securing member 48 of a grinding device. As seen the distance securing member 48 comprises a frame structure 49 and a plurality of rotatably mounted wheels 50 attached thereto. The curved portion 49 of the frame structure and the curved positioning of the rotatably mounted wheels 50 ensure that grinding of vertically curved surface portions of the rotor blade can be performed in uniform manner in that wheels 50 are adapted to abut the surface of the rotor blade during grinding.

Figure 9:
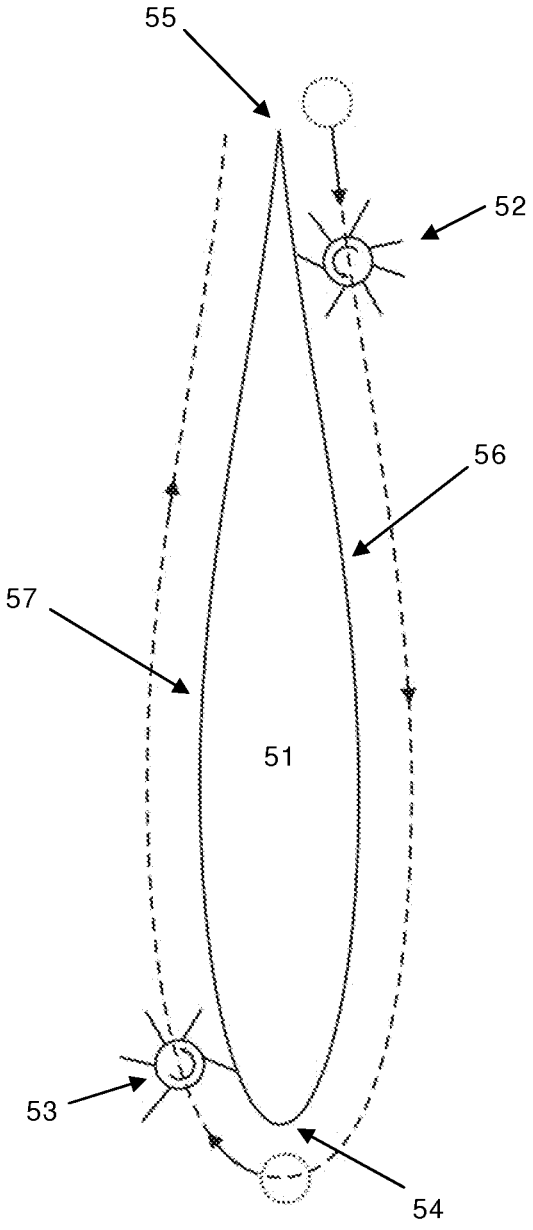
FIG. 9 shows, in a cross-sectional perspective, how rotor blade surfaces are treated.

FIG. 9 shows a cross-sectional view of a rotor blade 51 being oriented with its leading edge 54 facing downwards and its trailing edge 55 facing upwards. In principle, the rotor blade 51 can be oriented in an opposite manner, i.e. with its trailing edge 55 facing downwards and its leading edge 54 facing upwards.

It is a structural characteristic of wind turbine rotor blades that they are essentially insensitive to torsional stresses. This insensitiveness to torsional stresses may be exploited by treating, such as grinding, polishing, sand blasting or glass blasting, the rotor blade in an asymmetric manner. However, since a wind turbine blade, especially near its distal and thereby thinnest end, is bendable, simultaneous treatments of opposing surfaces of the rotor blade should preferably be performed in a balanced manner.

The rotor blade of FIG. 9 is being grinded by two grinding devices 52, 53 following the surface contours 56, 57 of the rotor blade 51. As depicted in FIG. 9 the grinding device 53 is moved from the leading edge 54 in the direction towards the trailing edge 55 of the rotor blade, whereas grinding device 52 is moved from the trailing edge 55 in the direction towards the leading edge 54 of the rotor blade by following the dashed lines in FIG. 9. The respective movements of the grinding devices 52, 53 are performed simultaneously.

Since a wind turbine rotor blade is essentially insensitive to torsional stresses surface finishing, such as surface grinding, may be performed in an asymmetric manner as illustrated in FIG. 9. However, to avoid unnecessary torsional load to be induced to the rotor blade and to avoid bending of the distal end of the rotor blade during surface treatment the forces provided by the two grinding devices 52, 53 are balanced.

The direction of rotation of the grinding devices 52, 53 may be as indicated in FIG. 9. However, the directions of rotation may optionally be reversed. In FIG. 9 the surfaces of the rotor blade are grinding by moving the two grinding devices in a clockwise direction relative to the rotor blade. However, moving the grinding devices in a counter clockwise direction relative to the rotor blade would also be applicable.

The two opposing surfaces 56, 57 of the rotor blade may be grinded by moving the grinding devices 52, 53 across the surfaces 56, 57 with a substantially constant speed. Alternatively, the surfaces 56, 57 may be grinding by moving the grinding devices across the surfaces 56, 57 with a speed being dependent on the contours of the rotor blade. Thus, the grinding machine carrying out a grinding method according to the present invention may be configured to move the grinding device 52 from the trailing edge to the leading edge, and moving the grinding device 53 from the leading edge to the trailing edge on essentially the same time.

The overall operation of the automatic surface finishing machine for carrying out the method according to the present invention is controlled by a PLC-based control module having a user friendly interface. The user of the automatic surface finishing machine enters control parameters to the control module via a touch screen provided on a control panel. The control module is capable of controlling and coordinating simultaneously movements of the machine along the longitudinal direction of the rotor blade, the vertical and horizontal movements of the two moveable arms, and the operation of the two surface finishing devices pivotably coupled to the two moveably arms. Thus, by entering only the dimensions of the rotor blade to be treated the surface finishing machine for carrying out the method according to the present invention automatically treats the two doubled-curved surfaces of the rotor blade. Compared to for example a manual grinding process of a 44 m rotor blade the required time for grinding such rotor blade is reduced significantly. In case of grinding, the grinding pattern applied, i.e. the pattern of movement of a grinding device relative to the surface to be grinded, by the automatic surface finishing machine can be chosen to match specific demands. Thus, among other grinding patterns a raster-like pattern can be applied. Other control related parameters, such as rotation speed of the grinding elements of grinding devices, grinding speed, potential spatial overlap between neighbouring grinding tracks can be varied to fulfil specific demands.

The invention claimed is:

1. A method for surface treatment of a rotor blade for a wind turbine, the rotor blade comprising a leading edge and a trailing edge separating substantially opposing first and second surfaces of said rotor blade, the method comprising:

supporting the rotor blade at least at a root end and at a distal position along a longitudinal axis of the rotor blade, wherein a supporting member at the root end is configured to prevent rotation of the rotor blade about the longitudinal axis of the rotor blade;

providing a moveably arranged first surface treatment device configured to provide surface treatment of the first surface of the rotor blade;

providing a moveably arranged second surface treatment device configured to provide surface treatment of the second surface of the rotor blade; and moving, via a control module, the first and second surface treatment devices in relative opposite directions during surface treatment of the first and second surfaces of the rotor blade, so that when the first surface treatment device moves toward the leading edge, the second surface treatment device moves toward the trailing edge, and vice versa.

2. The method according to claim 1, wherein the first and second surface treatment devices each comprises a distance arrangement adapted to abut the first or second surfaces during treatment of the rotor blade.

3. The method according to claim 2, wherein each distance arrangement comprises a first and a second set of rotatably mounted wheels.

4. The method according to claim 3, wherein the first set of wheels are arranged on a curved portion of a first mount, and wherein the second set of wheels are arranged on a curved portion of a second mount.

5. The method according to claim 1, wherein moving the first and second surface treatment devices comprises moving one surface treatment device from the trailing edge to the leading edge during surface treatment of one surface, while the other surface treatment device is moved from the leading edge to the trailing edge during surface treatment of the other surface.

6. The method according to claim 1, wherein the rotor blade, during treatment, is arranged substantially horizontally and is supported in such a way that the leading edge or the trailing edge defines an upper edge of the rotor blade.

7. The method according to claim 1, wherein the first and second surface treatment devices are moved between the leading and trailing edges at a substantially constant speed.

8. The method according to claim 1, wherein forces provided by the first and second surface treatment devices and acting on the rotor blade during surface treatment are balanced so that bending of the rotor blade along its longitudinal axis is essentially avoided.

9. The method according to claim 1, wherein the first surface treatment device is arranged on a first moveable arm being operatively connected to a frame structure configured to perform a relative movement along the longitudinal axis of the rotor blade, the first moveable arm being moveable in directions substantially perpendicular to the longitudinal axis of the rotor blade whereby the first surface treatment device is allowed to treat the first surface of the rotor blade, and wherein the second surface treatment device is arranged on a second moveable arm being operatively connected to the frame structure, the second moveable arm being moveable in directions substantially perpendicular to the longitudinal axis of the rotor blade whereby the second surface treatment device is allowed to treat the second surface of the rotor blade.

10. The method according to claim 1, wherein the first and second surface treatment devices comprise first and second grinding devices, respectively.

11. The method according to claim 1, wherein the first and second surface treatment devices comprise respective devices for polishing, sand blasting, glass blasting, or other physical treatment with an abrasive agent in order to provide surface finishing to at least a part of the rotor blade.

12. The method according to claim 1, wherein the first and second surface treatment devices are pivotably arranged.

13. The method according to claim 1, further comprising providing a dust removing arrangement adapted to lead dust away from the first and second surface treatment devices.

14. A method for surface treatment of a rotor blade for a wind turbine, the rotor blade comprising a leading edge and a trailing edge separating substantially opposing first and second surfaces of said rotor blade, the method comprising:

supporting the rotor blade at least at a root end and at a position along a longitudinal axis of the rotor blade, wherein a supporting member at the root end is configured to prevent rotation of the rotor blade about the longitudinal axis of the rotor blade;

providing a moveably arranged first surface treatment device configured to provide surface treatment of the first surface of the rotor blade;

providing a moveably arranged second surface treatment device configured to provide surface treatment of the second surface of the rotor blade; and moving, via a control module, the first and second surface treatment devices in relative opposite directions during surface treatment of the first and second surfaces of the rotor blade, so that when the first surface treatment device moves toward the leading edge, the second surface treatment device moves toward the trailing edge, and vice versa, wherein the first surface treatment device is arranged on a first moveable arm being operatively connected to a frame structure configured to perform a relative movement along the longitudinal axis of the rotor blade, the first moveable arm being moveable in directions substantially perpendicular to the longitudinal axis of the rotor blade whereby the first surface treatment device is allowed to treat the first surface of the rotor blade, and wherein the second surface treatment device is arranged on a second moveable arm being operatively connected to the frame structure, the second moveable arm being moveable in directions substantially perpendicular to the longitudinal axis of the rotor blade whereby the second surface treatment device is allowed to treat the second surface of the rotor blade.

15. An apparatus for surface treatment of a rotor blade for a wind turbine, comprising a leading edge and a trailing edge separating substantially opposing first and second surfaces of said rotor blade, the apparatus comprising:

a first supporting member configured to support the rotor blade at the root end, wherein the first supporting member is configured to prevent rotation of the rotor blade about a longitudinal axis of the rotor blade;

a second supporting member at a position along the longitudinal axis of the rotor blade;

a moveably arranged first surface treatment device configured to provide surface treatment of the first surface of the rotor blade; and a moveably arranged second surface treatment device configured to provide surface treatment of the second surface of the rotor blade; and a control module configured to move the first and second surface treatment devices in relative opposite directions during surface treatment of the first and second surfaces of the rotor blade, so that when the first surface treatment device moves toward the leading edge, the second surface treatment device moves toward the trailing edge, and vice versa.

16. The apparatus of claim 15, further comprising:

a frame structure configured to perform a relative movement along the longitudinal axis of the rotor blade;

a first moveable arm, being operatively connected to the frame structure and moveable in directions substantially perpendicular to the longitudinal axis of the rotor blade whereby the first surface treatment device is allowed to treat the first surface of the rotor blade; and a second moveable arm, being operatively connected to the frame structure, the second moveable arm being moveable in directions substantially perpendicular to the longitudinal axis of the rotor blade whereby the second surface treatment device is allowed to treat the second surface of the rotor blade, wherein the first surface treatment device is arranged on the first moveable arm and the second surface treatment device is arranged on the second moveable arm.

17. The apparatus of claim 15, wherein one or more of the first and second supporting members are configured to support the rotor blade, during treatment, in such a way that the rotor blade is arranged substantially horizontally and the leading edge or the trailing edge defines an upper edge of the rotor blade.

18. The apparatus of claim 15, wherein the first and second surface treatment devices are arranged to balance forces provided by the treatment devices and acting on the rotor blade during surface treatment, so that bending of the rotor blade along its longitudinal axis is essentially avoided.

19. The apparatus of claim 15, wherein the first and second surface treatment devices comprise respective grinding devices.

20. The apparatus of claim 15, wherein the first and second surface treatment devices comprise respective devices for polishing, sand blasting, glass blasting, or other physical treatment with an abrasive agent in order to provide surface finishing to at least a part of the rotor blade.

* * * * *